United States Patent [19]

Schramm

[11] 4,351,441

[45] Sep. 28, 1982

[54] DISPLAY STAND FOR GARMENTS

[75] Inventor: Werner Schramm, Munich, Fed. Rep. of Germany

[73] Assignee: PFP-Anstalt Für Produktentwicklung und Verwertung, Schaan, Liechtenstein

[21] Appl. No.: 140,595

[22] Filed: Apr. 15, 1980

[30] Foreign Application Priority Data

Apr. 21, 1979 [DE] Fed. Rep. of Germany ..... 2916226
Oct. 12, 1979 [DE] Fed. Rep. of Germany ..... 2941468

[51] Int. Cl.[3] ..... A47F 5/06

[52] U.S. Cl. ..... 211/207; 211/182; 211/205

[58] Field of Search ..... 211/205, 196, 207, 193, 211/204, 123, 190, 182; 248/158, 413, 218.4, 225.3 R, 219.4, 229

[56] References Cited

U.S. PATENT DOCUMENTS

| | | | |
|---|---|---|---|
| 2,540,023 | 1/1951 | Ackerman | 211/123 X |
| 2,895,618 | 7/1959 | Nathan | 211/123 |
| 2,970,798 | 2/1961 | Fritchle et al. | 248/229 |
| 4,030,691 | 6/1977 | Fleshman | 248/225.3 |
| 4,146,141 | 3/1979 | Winter et al. | 211/123 X |
| 4,253,578 | 3/1981 | Rekow | 211/204 X |

FOREIGN PATENT DOCUMENTS

| | | | |
|---|---|---|---|
| 496399 | 10/1950 | Belgium | 211/123 |
| 1755957 | 11/1957 | Fed. Rep. of Germany . | |
| 1966057 | 1/1967 | Fed. Rep. of Germany . | |
| 1510828 | 12/1967 | France | 211/193 |
| 2296389 | 7/1976 | France | 211/193 |

*Primary Examiner*—Roy D. Frazier
*Assistant Examiner*—Robert W. Gibson, Jr.
*Attorney, Agent, or Firm*—Cushman, Darby & Cushman

[57] ABSTRACT

A display stand for garments is provided with a plurality of support arms (3) having carrier rods (5) which serve to accommodate the hooks of coat hangers (7). The carrier rods (5) and the support arms (3) enclose an angle ($\alpha$) which in the horizontal projection is the complementary angle to 180° of the angle ($\beta$) enclosed between two adjacent support arms (3) arranged on a central stand.

The carrier rods (5) can be inclined at about 10° to 25° to the horizontal plane and are provided with detents (26) distributed on the carrier rods (5) along a generatrix which is associated with a diameter plane turned with respect to the horizontal plane through about 20° to 50°, preferably about 35° to 40°.

18 Claims, 8 Drawing Figures

Fig.3
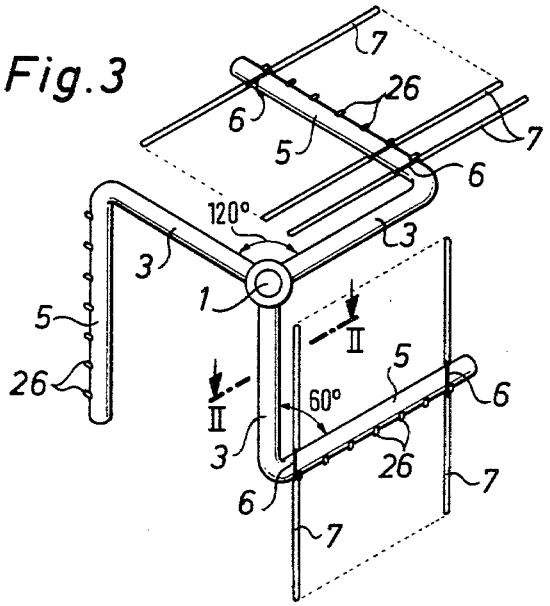
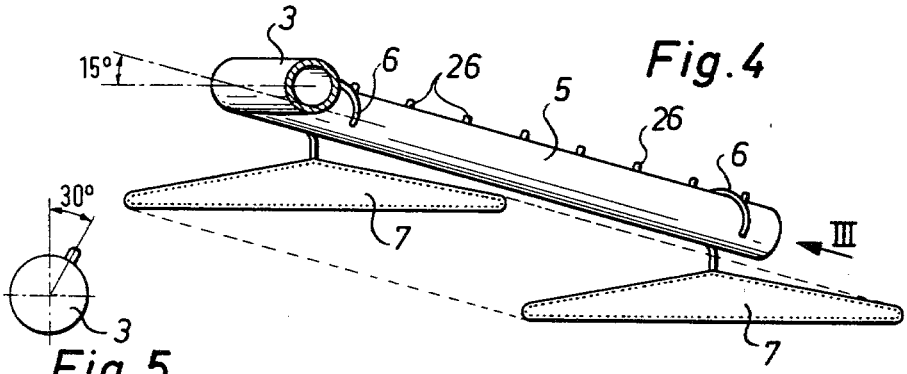
Fig.4
Fig.5
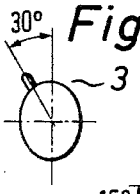
Fig.7
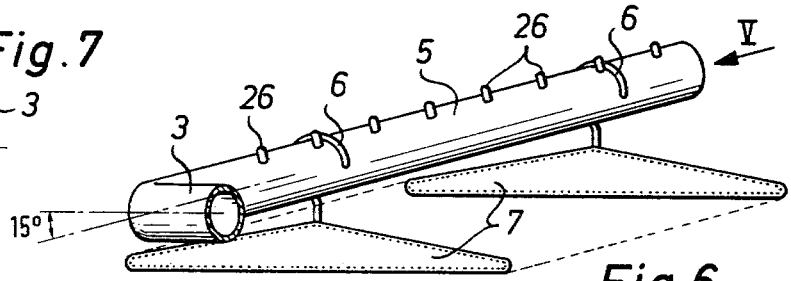
Fig.6

DISPLAY STAND FOR GARMENTS

The invention relates to a presentation or display stand for garments which is provided with a plurality of support arms which are arranged at an angle to each other on a central stand and which serve to accommodate the hooks of coat-hangers.

In known presentation or display stands of this type the individual support arms each lie in a horizontal plane and extend radially to the central stand. The hooks of the coat-hangers are hung over the support arms. A disadvantage with this known arrangement is that the axes of the support arms lie in each case perpendicular to the planes of the coat-hangers so that the coat-hangers extend tangentially to the central stand. As a result, relatively large dead spaces are formed between the individual support arms and cannot be filled by coat-hangers and garments. In addition, in the vicinity of the central stand either the coat-hangers collide with each other or spacers must be provided for adjacent coat-hangers so that even the space in the immediate vicinity of the central stand cannot be fully utilised.

When goods are hung for display, whether in the form of garments hung on coat-hangers or goods packed in bags arranged with a hook-like hanger in rows on carrier rods, it is desirable for the suspended goods to have substantially the same alignment. With round or oval carrier rods when using conventional coat-hangers suspended by a hook said hangers when freely suspended hang in a plane perpendicular to the carrier rod and as a rule on displacement swing back into this position. For optimal space utilisation and also for more attractive presentation, it may be desirable for the suspended goods or garments to assume an inclined position with respect to the carrier rod so that the individual garments are displayed to the observer in slightly projecting overlapping array.

For optimum display it is desirable for the customer to be able to remove the goods from the carrier rod and hang them on the latter again or touch the goods whilst they are suspended on the carrier rod. The alignment of the coat-hangers or suspension is thus disturbed so that in particular with loosely suspended goods the uniformly aligned display does not again occur automatically and the display is made less attractive by irregularly hanging articles.

The invention is accordingly based on the problem of constructing a display stand of the type mentioned at the beginning so that good utilisation of the space occupied thereby in the filled state is achieved. Furthermore, provisions are to be made with which it is possible to suspend goods on a carrier rod, automatically assuming a uniformly directed alignment inclined to the carrier rod.

This problem is solved according to the invention in that at the free ends of the support arms carrier rods for the hooks of the coat-hangers are connected and enclose with the associated support arms an angle which in the horizontal projection is the complementary angle to 180° of the angle enclosed between two adjacent support arms.

With this arrangement, the carrier rods of a support arm extend in the horizontal projection parallel to the support arm adjacent said carrier rod. Consequently, the individual garments can be arranged with their hooks on the carrier rods so that their planes are parallel to the support arms and not at right-angles thereto as in the known arrangement so that the coat-hangers project with their one half into the respective intermediate space between the parallel extending carrier rods and carrier arms and fill said intermediate space.

With this angular relationship according to the invention mentioned above between the support arms and the carrier rods the free spaces may be fully utilised in the manner described independently of the number of carrier arms.

However, a particularly advantageous embodiment has proved to be a display stand which is provided with three support arms and three carrier rods, the support arms being arranged accordingly at an angle of 120° to each other.

The use of three support arms and three carrier rods also has the advantage that the total diameter of a full stand formed in this manner is only slightly greater than two coat-hanger lengths because with a parallel array of the planes of the coat-hangers to the support arms the latter enclose with the respective carrier rod an angle of 60° so that the individual garments suspended on the coat-hangers appear offset with respect to each other and the rear garments project laterally beyond those infront. Apart from the excellent space utilisation of a stand constructed in this manner a particularly clear and attractive display is thus obtained.

It is further particularly advantageous if in the horizontal projection the parallel spacing between the individual carrier rods and the adjacent support arms is only slightly greater than half the length of a coat-hanger plus the thickness of the garment disposed on the coat-hanger. With such an arrangement the aforementioned space is particularly well filled.

To prevent garments from being able to swing past the support arm into the respective adjacent intermediate space at the associated support arm it is advantageous if, on the central stand or on the support arms, stops are provided for the inner end of the first inner coat-hanger. The stops may consist of flat webs which project into the associated intermediate space and which can be disposed on at least one sleeve adjustable on the central stand. In particularly advantageous manner the stops may be formed by the support arms themselves in that the latter are upwardly inclined with the respect to the stand. The axis of the respective support arm encloses with the axis of the stand an angle which is so dimensioned that the respective inner end of the inner coat-hanger strikes against the rising support arm.

In advantageous manner, the support arms and carrier rods may be made integral so that the carrier rods represent an angled portion of the support arms. In this case in particular it is expedient if in the connection region between the carrier rods and the support arms on the carrier rods an upwardly directed limiting pin or the like is provided for the hook of the inner coat-hanger so that the latter cannot slide down over the angled end.

The inner ends of the carrier arms may in particularly advantageous manner be disposed on a sleeve which is displaceable and/or rotatable with respect to the stand and which can be locked in the respective adjustment position.

Furthermore, the inner ends of the support arms may be provided with vertical portions which can be inserted in interchangeable and turnable manner into clamping sleeves or the like of the stand. In this manner, one and the same stand may be equipped with various support arms in various vertical positions to enable the stand to be adapted to the particular requirements especially as regards garments of different length or to enable different garments to be disposed vertically above each other on one and the same stand. Conveniently the clamping sleeves are disposed on the sleeve displaceable on the stand.

According to a further embodiment of the invention the carrier rod extends inclined to the horizontal plane and is provided with detents for the hooks or coat-hangers and the detents are distributed on the surface of the carrier rod along a generatrix which is associated with a diameter plane turned with respect to the horizontal plane through about 20° to 50°, preferably about 35° to about 40°.

With these features, it is achieved in advantageous manner that the garments suspended by means of coat-hangers or hooks on the carrier rods turn automatically by their own weight into an inclined position and retain this position in stable location. This provides the advantage that even articles hung loosely on a carrier rod with relatively large intermediate spaces retain or reassume this desired position when they are pivoted during inspection by the customer or removed and then replaced.

Furthermore, according to a preferred embodiment of the invention the carrier rod is inclined upwardly or downwardly to the horizontal plane by about 10° to 25°, preferably about 15°. The detents on the carrier rod consist preferably of pin-like or stud-like projections.

In a particularly advantageous embodiment the carrier rod is made round or slightly elliptical, the longer major axis extending vertically in a carrier rod with elliptical cross-section.

The advantages and features of the invention will be apparent from the following description of examples of embodiment in conjunction with the planes and drawings, wherein:

FIG. 3 is a plan view of a display stand according to a further embodiment.

FIG. 4 is a section along the line II—II of FIG. 3,

FIG. 5 is a plan view of the end of the carrier rod in the direction of the arrow III of FIG. 4, FIG. 6 is a section along the line II—II of FIG. 3 for a modified embodiment of the display stand, FIG. 7 is a plan view of the end of the carrier rod in the direction of the arrow V of FIG. 6.

Figure 1:
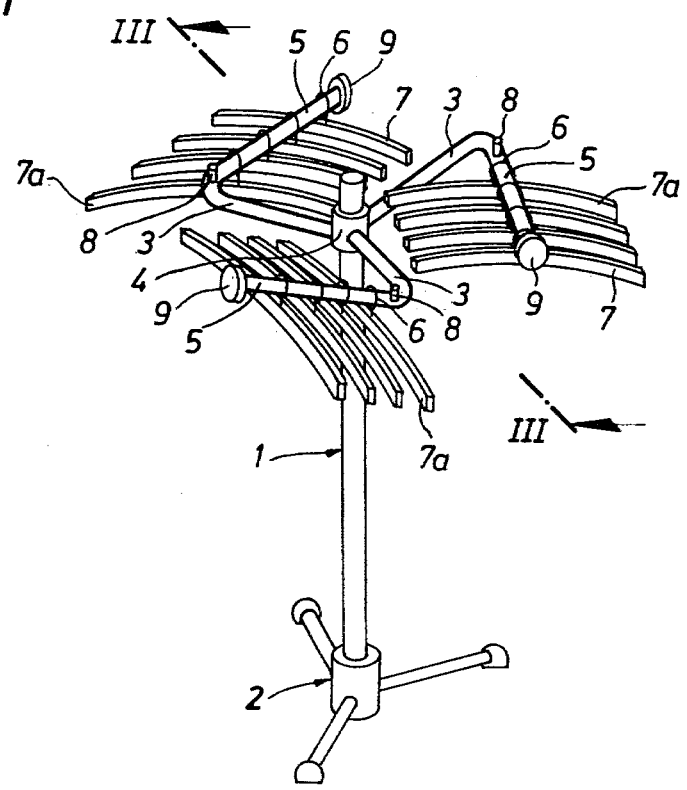
FIG. 1 shows in perspective view an embodiment of the display stand according to the invention.

According to FIG. 1 the display stand comprises a vertical central stand 1 which is provided with a foot 2. Disposed on the stand 1 are support arms 3 which enclose in the example of embodiment illustrated in each case an angle of 120° (cf. FIG. 2). The support arms may be mounted directly on the stand 1 or on a sleeve 4 fitted to the stand. Connected to the free ends of the support arms 3 are carrier rods 5 which in the example of the embodiment illustrated are integral with the support arms 3 and consequently represent the angled portion of the support arms. The carrier rods 5 accommodate the hooks 6 of coat-hangers 7 which carry the garments to be displayed.

Figure 2:
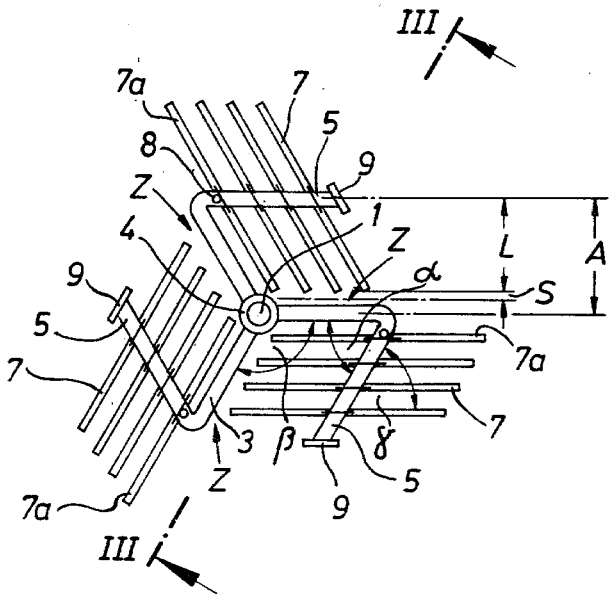
FIG. 2 is a plan view of the display stand according to FIG. 1.

FIG. 2 is a plan view of the display stand according to FIG. 1 and shows that the three support arms enclose an angle of $\beta$ of 120° which in the horizontal projection according to FIG. 2 is the complementary angle to 180° of the angle $\alpha$ which is enclosed by the carrier rods 5 and the associated support arms 3 and which in the example of the embodiment illustrated is thus 60°. Condequently, the carrier rods 5 always extend parallel to the adjacent support arms 3 and, as illustrated in FIG. 2 the coat-hangers 7 may be arranged on the carrier rods 5 in such a manner that they also lie with their planes parallel to the support arms 3. The garments 7 thus project with their one half into the respective intermediate space Z between the parallel extending carrier rods and support arms so that the intermediate space Z can be completely filled.

Due to the parallel arrangement of the coat-hangers 7 with respect to the support arms 3 the garments enclose with their planes an angle $\gamma$ with the carrier rods 5 which corresponds to the angle $\alpha$ between the support arms 3 and the carrier rods 5 and consequently in the example of embodiment illustrated is also 60°. Because of this angular position of the coat-hangers 7 with respect to the carrier rods 5 the garments disposed on the inner coat-hangers project laterally with respect to the outer ones so that the garments are offset with respect to each other and thus better displayed.

As apparent from FIGS. 1 and 2, in the angled region between the support arms 3 and the carrier rods 5 in each case an upwardly directed limiting pin 8 is provided which prevents the hooks of the respective inner coat-hangers 7*a* from slipping on to the support arms 3. A further limiting means in the form of a knob 9 is disposed at the respective free end of the carrier rod 5. This knob 9 may be used for a marking indicating the nature of the garments and carry for example the sizes or the like.

As shown in FIG. 2, in the corresponding arrangement of the coat-hangers the parallel spacing A between the individual carrier rods 5 and the adjacent support arms 3 is only slightly greater than half the length L of a coat-hanger 7 plus the thickness S of the garment disposed on the coat-hanger. Thus, excellent space utilization up to the central stand 1 is guaranteed without the garments colliding with those in the adjacent intermediate space Z.

The display stand is illustrated in plan view in FIG. 3 consists of a vertical upright stand tube 1 on which three support arms 3 are arranged radially offset, every two support arms enclosing an angle of about 120°. Connected at an angle at the free ends of the support arms 3 are carrier rods 5 which in the example of embodiment illustrated are formed integrally with the support arms 3 and enclose with said arms an angle of 60°. The hooks 6 of coat-hangers 7 or article bags, not illustrated, are hung on the carrier rods 5. At a spacing provided for the suspension of the individual articles pin-like projections 26 are disposed on the carrier rods 5 and extend along a generatrix whose associated diameter plane is angularly offset with respect to the vertical diameter plane. FIGS. 4 and 6 illustrate sections showing two different forms of attaching the carrier rods 5. In the example of embodiment according FIG. 4 the carrier rod 5 extends inclined dropping outwardly whereas in the embodiment to FIG. 6 the carrier rod 5 has an upward inclination. Proceeding on the basis of the alignment illustrated in FIG. 3 of the plane through the coat-hangers at 60° with respect to the carrier rod 5, which with the display stand illustrated permits suspension of goods with optimum density per unit area of display space required, the pin-like projections 26 extend along a generatrix whose associated diameter plane is outwardly turned with respect to the perpendicular diameter plane.

In the embodiment according to FIG. 6 the carrier rod 5 is upwardly inclined to the horizontal plane, the pin-like projections 26 being disposed along a generatrix whose associated diameter plane is turned inwardly with respect to the perpendicular plane. In the embodiments illustrated a turning of the diameter plane associated with the generatrix of 30° in each case has been chosen, the inclination of the carrier rod to the horizontal plane extending at an angle of about 15°. As further apparent from FIG. 6, for the support arm and carrier rod a tube may be used which has a slightly elliptical cross-section, the major axis of the elliptical cross-section extending vertically.

The indicated magnitude of the angle of inclination of 15° for the carrier rod and the turning of the diameter plane extending through the plane of the pin-like projections through 30° with respect to the vertical diameter plane are only optional quantities because the desired effect also occurs with angles differing considerably from these angle magnitudes. The choice of angle is made primarily with regard to aspects depending on the type of display desired and the angle at which the coat-hangers or goods wrappings are to be suspended with respect to the longitudinal direction of the carrier rod 5.

For the realisation of the invention it is of no consequence in which manner the carrier rod is held and in particular there is no restriction to the display stand illustrated. On the contrary, the carrier rods may be held in any desired manner depending on the desired presentation. Thus, for example, the carrier rods may be arranged parallel to each on a wall or rail at an angle differing from 90° and by employing the invention the suspended coat-hangers can be aligned parallel to the wall or rail and thus expose to observation the overlapping projecting sides of the suspended articles. In this manner, similar goods in different colours may be displayed very attractively.

Also provided on the stand or stand tube 1 is a sleeve 10 which is displaceable and/or rotatable with respect to said tube and carries further clamping sleeves 11 into which the support arms 3 may be inserted. This situation is shown in the partial view of FIG. 8. Accordingly, the inner ends of the support arms 3 are provided with perpendicularly angled portions 3*b* with which they can be inserted into the clamping sleeves 11 which may be provided with locking screws 12 or the like for clamping the ends 3*b* of the support arms 3. The sleeve 10 may in turn be arranged longitudinally displaceably and/or rotatably on the stand 1 and provided with clamping screws 13 with which it can be locked in the respective adjustment position with respect to the stand 1. As illustrated, this embodiment also makes it possible to insert the support arms 3 provided with the carrier rods 5 conversely from below into the clamping sleeves 11 and locked in this position so that universal adaptation of the display stand is possible to different garments and/or garments of different lengths, and furthermore a plurality garments may be disposed above each other, for example also using a plurality of sleeves formed according to FIG. 8.

Figure 8:
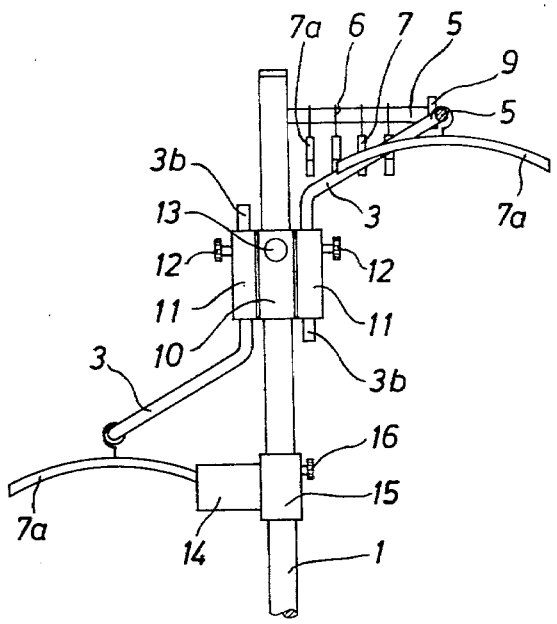
FIG. 8 is a partial view of the display stand according to FIGS. 1 and 3.

Since with the arrangement according to FIG. 8 for the support arm 3 shown on the left in FIG. 6 said arm can no longer form the stop for the inner coat-hanger 7*a*, in this embodiment a flat web 14 is provided on which the inner end of the coat-hanger 7*a* strikes. The web 14 is in turn mounted on a sleeve 15 which is provided with a clamping screw 16 and can accordingly be aligned on the stand 1.

What is claimed is:

1. A display stand for hanging articles including central support means for providing support for the device, a plurality of support arms having one end secured to said central support means at a first predetermined angle to each other, a carrier rod having one end secured to the other end of each of said plurality of support arms at an angle which, in a horizontal projection, is the complementary angle to 180 degrees of said first predetermined angle, wherein the stand is provided with three support arms and three carrier rods further including stops secured to said central support means to control movement of the hung items wherein said stops include a plurality of flatly formed webs projecting into the space defined between each of said support arms and its associated carrier rod.

2. A display stand according to claim 1 wherein the device is used to support coat-hangers with the spacing between individual carrier rods and adjacent support arms being only slightly greater than half the length of the coat-hanger plus the thickness of the article disposed on the coat-hanger.

3. A display stand according to claim 2 wherein said support arms are disposed on a sleeve displacably mounted on said central support means, said sleeve including means for releasably locking the sleeve in a desired position.

4. A display stand as in claim 3 wherein said sleeve includes a clamping member having means defining a bore extending therethrough, said support arms each having the portion mounted to said sleeve provided with a mounting extension adapted to fit within said bore so that said support arms can be positioned within the bore of said clamping member from either end thereof.

5. A display stand according to claim 1 wherein said webs are disposed on a sleeve member adjustably mounted to said central support means.

6. A display stand as in claim 1 wherein said central support means has a vertical axis and each of said plurality of support arms have an axis, with each of said plurality of support arms being inclined upwardly so that a predetermined angle is established between the axis of each of said support arms and the vertical axis of said central support means thereby allowing each of said support arms to act as said stop.

7. A display stand according to claim 1 wherein the support arm and the carrier rods are one piece, integral structures.

8. A display stand according to claim 1 wherein the other end of each of said carrier rods is provided with a stop member.

9. A display stand for hanging articles including central support means for providing support for the device, a plurality of support arms having one end secured to said central support means at a first predetermined angle to each other, a carrier rod having one end secured to the other end of each of said plurality of support arms at an angle which, in a horizontal projection, is the complementary angle to 180 degrees of said first predetermined angle wherein each support arm is inclined to the horizontal plane and said carrier rod is provided a plurality of spaced apart projections for spacing apart the hanging articles, said projections being distributed on the surface of said carrier rod along a generatrix which is associated with a diameter plane turned with respect to a vertical plane through an angle of about 20 degrees to about 50 degrees.

10. A display device as in claim 9 wherein said angle is preferably from about 35° to about 40°.

11. A display stand according to claim 10, wherein said carrier rod is inclined downwardly with respect to the horizontal plane at an angle ranging between about 10° to about 25°.

12. A display stand as in claim 11, wherein the angle is preferably about 15°.

13. A display stand according to claim 9 wherein the carrier rod is inclined upwardly with respect to the horizontal plane at an angle ranging between about 10° to about 25°.

14. A display stand as in claim 13 wherein the angle is preferably about 15°.

15. A display stand according to any one of claims 10, 13, 14, 11, 12 or 9, wherein the projections are comprised of stud-like projections.

16. A display stand as in claim 9, wherein the carrier rod is round.

17. A display stand as in claim 9, wherein the carrier rod is made slightly elliptical with the longer major axis extending vertically.

18. A display stand for articles comprising a central support, a plurality of support arms secured to said central support so as to extend therefrom at spaced intervals about said central support, a carrier rod secured to each of said support arms, said support rods being inclined with respect to a horizontal plane at the point of attachment to said central support, each of said carrier rods including a plurality of spaced apart stops for spacing apart the articles, said stops being distributed along the surface of said carrier rod along a generatrix which is associated with a diameter plane turned with respect to a vertical plane through an angle of about 20 degrees to about 50 degrees.

* * * * *